US009552760B2

(12) United States Patent
Kawabe

(10) Patent No.: US 9,552,760 B2
(45) Date of Patent: Jan. 24, 2017

(54) DISPLAY PANEL

(71) Applicant: Global OLED Technology LLC, Herndon, VA (US)

(72) Inventor: Kazuyoshi Kawabe, Tokyo (JP)

(73) Assignee: Global OLED Technology LLC, Herndon, VA (US)

( * ) Notice: Subject to any disclaimer, the term of this patent is extended or adjusted under 35 U.S.C. 154(b) by 0 days.

(21) Appl. No.: 15/074,770

(22) Filed: Mar. 18, 2016

(65) Prior Publication Data

US 2016/0203756 A1 Jul. 14, 2016

Related U.S. Application Data

(63) Continuation of application No. 14/184,879, filed on Feb. 20, 2014, now Pat. No. 9,324,249, which is a continuation of application No. 12/922,673, filed as application No. PCT/US2009/001682 on Mar. 17, 2009, now abandoned.

(30) Foreign Application Priority Data

Mar. 19, 2008 (JP) ..... 2008-070549

(51) Int. Cl.

| | |
|---|---|
| ***G09G 3/30*** | (2006.01) |
| ***G09G 3/20*** | (2006.01) |
| ***G09G 3/00*** | (2006.01) |
| ***G09G 3/32*** | (2016.01) |

(52) U.S. Cl.

CPC ..... *G09G 3/2092* (2013.01); *G09G 3/00* (2013.01); *G09G 3/3233* (2013.01); *G09G 2300/0819* (2013.01); *G09G 2300/0842* (2013.01); *G09G 2300/0861* (2013.01); *G09G 2320/0233* (2013.01); *G09G 2330/021* (2013.01)

(58) Field of Classification Search

CPC .. G09G 3/3233; G09G 3/3208; H01L 27/1214
USPC ..... 345/76, 77, 82, 90
See application file for complete search history.

(56) References Cited

U.S. PATENT DOCUMENTS

| | | | | |
|---|---|---|---|---|
| 6,229,508 | B1 * | 5/2001 | Kane | G09G 3/3233 345/205 |
| 6,876,345 | B2 * | 4/2005 | Akimoto | G09G 3/3258 345/76 |
| 7,057,588 | B2 | 6/2006 | Asano et al. | |
| 7,084,848 | B2 | 8/2006 | Senda et al. | |
| 7,286,105 | B2 | 10/2007 | Akimoto et al. | |
| 7,508,361 | B2 | 3/2009 | Uchino et al. | |
| 7,825,878 | B2 | 11/2010 | Kawabe | |

* cited by examiner

*Primary Examiner* — Calvin C Ma
(74) *Attorney, Agent, or Firm* — Global OLED Technology LLC

(57) ABSTRACT

An EL light-emitting element is driven digitally to reduce power consumption using a pixel having three transistors and two capacitors. A reset transistor for diode connection writes the threshold voltage of the drive transistor onto a coupling capacitor. The data voltage plus threshold voltage is then written onto the gate of the drive transistor. This reduces the amplitude of the data voltage required, further reducing power consumption.

3 Claims, 7 Drawing Sheets

DISPLAY PANEL

RELATED APPLICATIONS

This is a continuation of U.S. application Ser. No. 14/184,879, filed Feb. 20, 2014, which is a continuation of application Ser. No. 12/922,673, filed Dec. 13, 2010, now abandoned, which was originally filed as application No. PCT/US2009/001682 on Mar. 17, 2009.

FIELD OF THE INVENTION

The present invention relates to a display panel including pixels disposed in a matrix shape.

BACKGROUND OF THE INVENTION

Organic EL displays, which are self-emission type displays, are advantageous in high contrast and high-speed response and are therefore suitable for moving image applications such as televisions which display natural images. In general, organic EL elements are driven by using control elements such as transistors, and multi gray level display may be achieved by driving the transistors with a constant current in accordance with data, or by driving the transistors with a constant voltage to vary the light emission period.

Here, with the constant current driving in which the transistors are used in the saturation region, variations in the characteristics of the transistors such as threshold values and mobility would cause a variation in the electric current flowing in the organic EL element, which results in non-uniform display. In order to deal with this disadvantage, WO 2005/116971 A1 discloses a method in which transistors are used in the linear region and digitally driven with a constant voltage, thereby improving the display non-uniformity.

In the digital driving method disclosed in WO 2005/116971 A1, because one frame period is divided into a plurality of sub frames and each pixel is accessed a number of times corresponding to the number of sub frames, it is necessary to supply data to the data lines at high frequencies in accordance with the sub frames. When the data lines are driven by high frequencies as described above, the power consumption is increased in order to achieve high-speed charge and discharge of the data lines. Further, while a sufficient signal amplitude must be ensured for reliably turning the transistors ON and OFF when there is a variation in the threshold values and the mobility of the transistors, this makes a reduction in the power consumption difficult because the power consumption increases as the amplitude of a signal to be supplied to the data line is increased.

SUMMARY OF THE INVENTION

In accordance with one aspect of the invention, there is provided a display pixel, comprising:

(a) a coupling capacitor having a first terminal connected to a data line;

(b) a selection transistor having a first terminal connected to a second terminal of the coupling capacitor, and a gate connected to a selection line;

(c) a driving transistor having a gate connected to a second terminal of the selection transistor, wherein the driving transistor supplies a current in accordance with a gate potential;

(d) a light emitting element connected to a second terminal of the driving transistor and emitting light as a result of an electric current supplied by the driving transistor;

(e) a reset transistor having a first terminal connected to the second terminal of the driving transistor; a second terminal connected to the first terminal of the selection transistor; and a gate connected to a reset line; and (f) a storage capacitor connected to the gate of the driving transistor.

Further, it is preferable that, in a state in which a voltage of a data line is maintained to a fixed voltage, by turning a reset transistor ON with a selection transistor being turned OFF, a potential on the drain side of a driving transistor is written in a coupling capacitor, and then, by turning the selection transistor ON with the reset transistor being turned OFF, the potential written in the coupling capacitor is written in a storage capacitor and the gate potential of the driving transistor is inverted, and with repetition of the above operation once again, the gate potential of the driving transistor is returned to an original state, and the voltage written in the storage capacitor is maintained without changing the potential of the data line.

It is also preferable for a plurality of pixels to form a unit pixel, in which the selection transistor of each pixel is connected to a different selection line and the reset transistor of each pixel is connected to a common reset line.

According to the present invention, it is possible to write a voltage in accordance with the characteristics of the driving transistor in the coupling capacitor, by way of resetting. Consequently, a difference between a High voltage which is required for turning the driving transistors ON and OFF and a Low voltage can be set independently of a variation in the characteristics of the driving transistors, thereby permitting a reduction in the difference between the High voltage and the Low voltage. Accordingly, the amplitude of the voltage fluctuation of the data lines can be reduced, so that low power consumption can be achieved.

BRIEF DESCRIPTION OF THE DRAWINGS

A preferred embodiment of the present invention will be described in detail based on the following figures, wherein.

DETAILED DESCRIPTION OF THE INVENTION

A preferred embodiment of the present invention will be described in detail with reference to the accompanying drawings.

Figure 1:
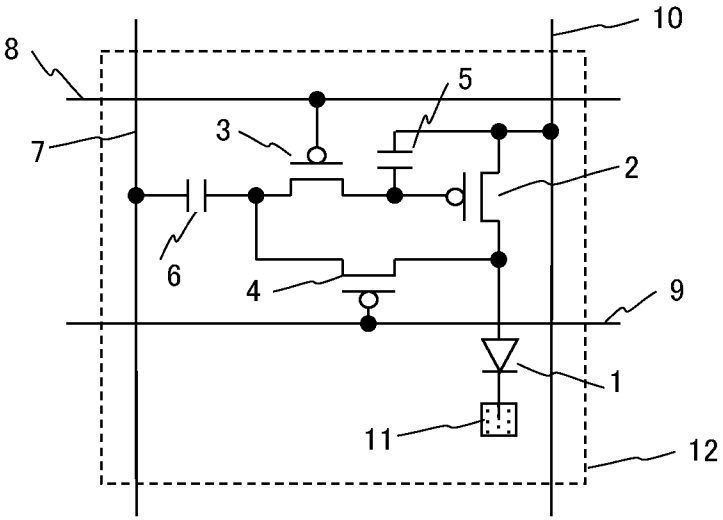
FIG. 1 is a diagram showing a structure of a pixel circuit.

FIG. 1 shows an example structure of a pixel 12 in a display according to an embodiment of the present invention. The pixel 12 includes an organic EL element 1 which is a light emitting element, a driving transistor 2, a selection transistor 3, a reset transistor 4, a storage capacitor 5, and a coupling capacitor 6. Here, all these transistors are P-type thin film transistors.

A source terminal of the driving transistor 2 is connected to a power source line 10 which is common for all the pixels.

Further, a drain terminal of the driving transistor 2 is connected to an anode of the organic EL element 1 and to a source terminal of the reset transistor 4. A gate terminal of the driving transistor 2 is connected to one terminal of the storage capacitor 5 having the other terminal thereof connected to the power source line 10, and is also connected to a source terminal of the selection transistor 3. The selection transistor 3 has a gate terminal connected to a selection line 8 and a drain terminal which is connected to one terminal of the coupling capacitor 6 having the other terminal thereof connected to a data line 7 and which is also connected to a drain terminal of the reset transistor 4. A gate terminal of the reset transistor 4 is connected to a reset line 9, and a cathode of the organic EL element 1 is connected to a cathode electrode 11 which is common for all the pixels.

Figure 2:
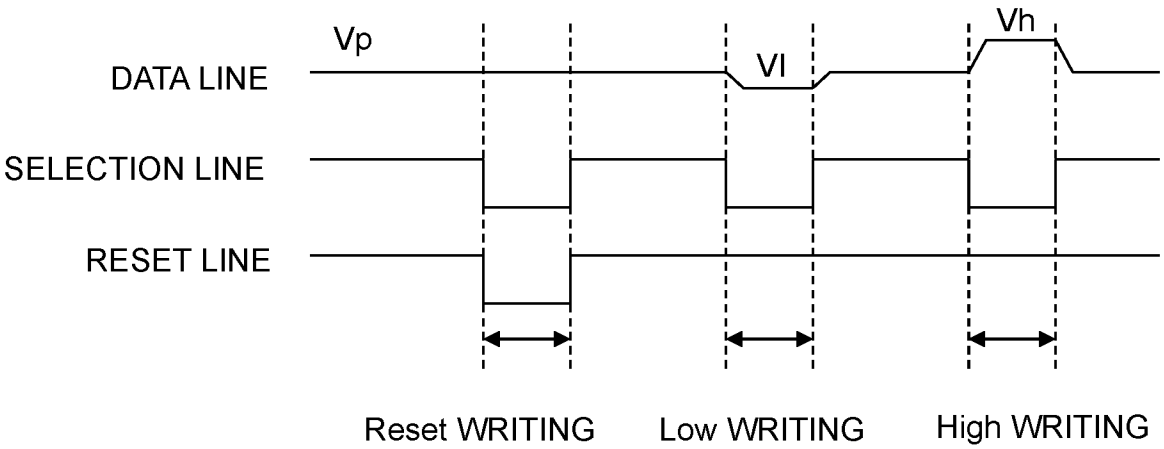
FIG. 2 is a diagram showing a state of each line at the time of data writing.

FIG. 2 shows waveforms of signals to be input to the data line 7, the selection line 8, and the reset line 9 for driving the pixel 12. First, when a pre-charge (preset) potential Vp, which is an intermediate potential between High and Low, for example, is applied to the data line and both the selection line 8 and the reset line 9 are turned Low, the selection transistor 3 is turned ON and the reset transistor 4 is turned ON, and connection of the gate terminal and the drain terminal of the driving transistor 2 (diode connection) is achieved, whereby current flows in the organic EL element 1. At this time, a potential (reset potential) Vr which is divided by the organic EL element 1 and the driving transistor 2 is generated at the gate terminal of the driving transistor 2 and is written in the storage capacitor 5 and the coupling capacitor 6.

Thereafter, when writing Low data, a Low potential Vl(<Vp) is supplied to the data line 7, and with only the selection line 8 being set to Low, the Low data is written in the storage capacitor 5 via the coupling capacitor 6. While a potential of (Vp−Vr) is stored in the coupling capacitor 6 at the time of reset, when the Low potential Vl is applied to the data line 7, a gate voltage of the driving transistor 2, which is Vg=Vr−(Vp−Vl), is generated and the driving transistor 2 is turned ON due to the gate potential which is lower than the reset potential. Here, it is assumed that the coupling capacitor 6 is sufficiently larger than the storage capacitor 5. When writing High data, on the other hand, a High potential Vh(>Vp) is supplied to the data line 7, and with the selection line 8 being set to Low, a gate potential, which is Vg=Vr+(Vh−Vp), is written in the storage capacitor 5 via the coupling capacitor 6, whereby the driving transistor 2 can be turned OFF. The preset potential Vp may be arbitrarily set as required.

It is generally known that the threshold values and mobility vary among pixels when a transistor is formed using low-temperature poly-silicon and so on. According to the present embodiment, however, the potential which is generated at the gate terminal of the driving transistor 2 varies when diode connection of the driving transistor 2 is achieved, as described above. More specifically, because a voltage in accordance with the threshold value and the mobility of the driving transistor 2 is generated at the connection point between the organic EL element and the drain of the driving transistor 2, the reset potential to be written in the storage capacitor 5 and the coupling capacitor 6 varies for each pixel.

Figure 3:
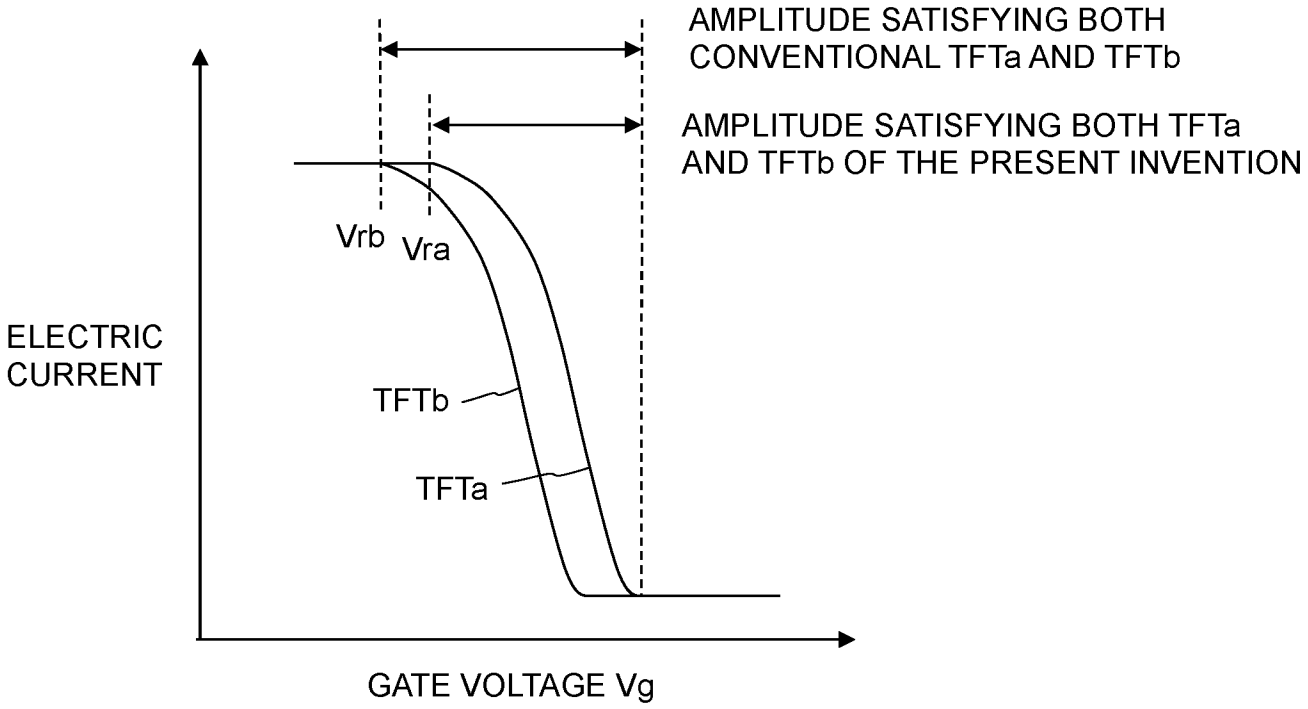
FIG. 3 is a diagram for explaining variations of characteristics of driving transistors.

FIG. 3 shows a relationship of an electric current flowing in the organic EL element 1 and the gate potential Vg which is applied to the driving transistor 2 when two different transistors (TFTa and TFTb) are used as the driving transistor 2. As shown, the reset potential Vra is higher with regard to the TFTa through which it is easy for an electric current to flow, and the reset potential Vrb is lower with regard to the TFTb through which it is difficult for an electric current to flow. The reset potential Vra, Vrb is a potential at which the driving transistor 2 starts operating in the linear region. Accordingly, with the conventional digital driving, it was necessary to supply a gate potential which is lower than the reset potential to the gate terminal of the driving transistor 2. However, because the reset potential varies for each pixel as described above, it was necessary to set the Low potential Vl to a significantly low potential so as to turn OFF the electric current in all the pixels. Similarly, the High potential Vh was set to a significantly high potential so as to turn the driving transistors 2 OFF in all the pixels. Consequently, the conventional digital driving was disadvantageous in that the amplitude Vh−Vl of a signal supplied to the data line 7 is increased to make a reduction in the power consumption difficult with the increase in the frequencies for digital driving.

According to the present embodiment, on the other hand, by performing a reset operation by way of the coupling capacitor 6, it is possible to hold the reset potential which varies for each pixel as an offset by the coupling capacitor 6 and then reflect this reset potential in the gate potential of the driving transistor 2. Specifically, according to the present embodiment, the potentials Vh and Vl can be set regardless of the variations in the transistors.

While, during the non-selection period, the selection transistor 3 and the reset transistor 4 are turned OFF, a leakage current is likely to be generated in the reset transistor 4, for the following reasons. Specifically, when black level Vh, as video data, is written in the pixel 12, the gate potential is Vg=Vr+(Vh−Vp)≈Vdd−Vth, as a result of which substantially no electric current flows in the organic EL element 1, and the potential of the source terminal of the reset transistor 4 is reduced close to the cathode potential VSS, whereas the drain potential of the reset transistor 4 remains Vdd−Vth, leading to a significant difference in the potentials between the source and drain of the reset transistor 4.

In the pixel 12, as the selection transistor 3 is disposed between the gate terminal of the driving transistor 2 and the drain terminal of the reset transistor 4, even when the drain potential of the reset transistor is lowered due to the leakage current, the gate potential of the driving transistor 2 is not affected by the lowering of the drain potential, and the gate potential which is written is maintained.

Figure 4:
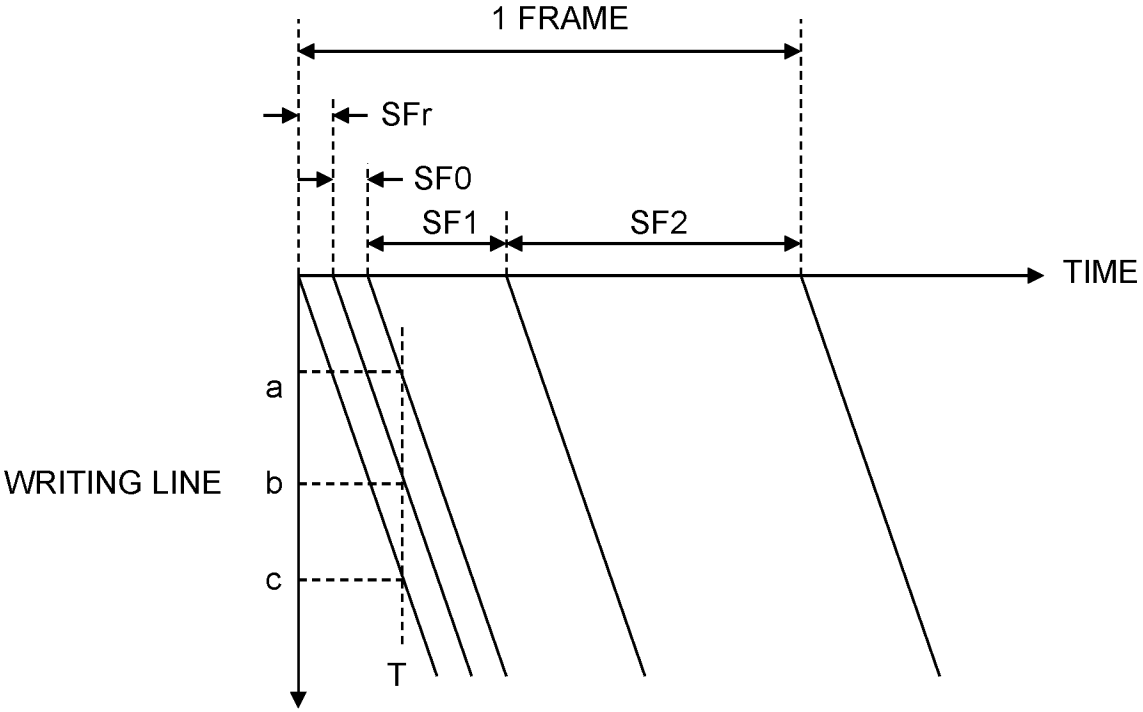
FIG. 4 is a diagram for explaining data writing of sub-frames.

FIG. 4 shows timing of digital driving in which 3-bit display of each pixel is performed by using four sub-frames. A sub-frame SFr for reset is first started, and then, a sub-frame SF0 for bit 0, a sub-frame SF1 for bit 1, and a sub-frame SF2 for bit 2 are sequentially started. While in FIG. 4 a plurality of lines a, b, and c must be selected during a certain period T, time-division selection can be achieved without any inconsistency by using a method disclosed in WO 2005/116971 A1.

With the above structure shown in FIG. 4, which can be achieved simply by adding the sub-frame SFr for reset to the sub-frame structure in the related art, more-bit display can be easily achieved in a similar manner.

Figure 5:
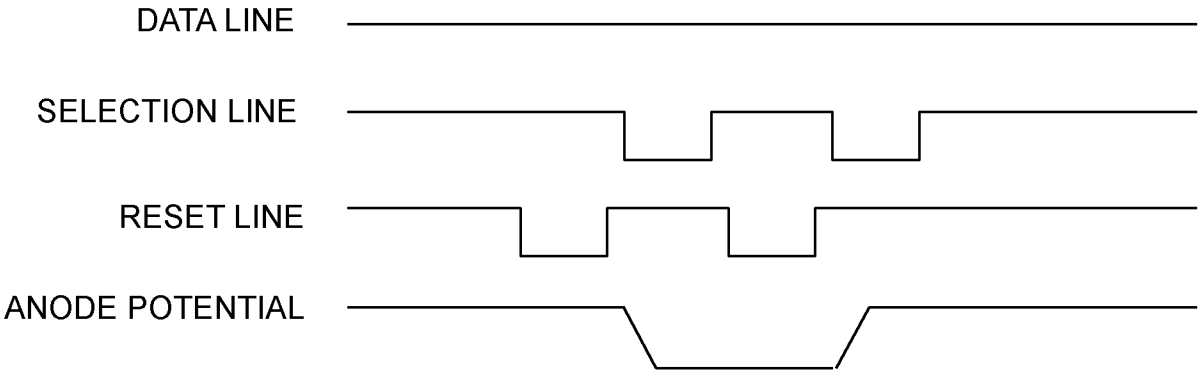
FIG. 5 is a diagram showing a state of each line at the time of maintaining data.

Further, with the use of the pixel 12 shown in FIG. 1, as data which is written once in the pixel can be continuously held not via the data line 7, a quasi-static operation can be performed. FIG. 5 shows timing for holding the same data without supplying the data to the data line 7. Specifically, when the reset line is set to Low with the potential of the data line 7 being fixed (to High level in this example), the anode potential (High) of the organic EL element 1 which is currently emitting light is written in the coupling capacitor 6. Thereafter, by setting the selection line 8 to Low, the anode potential (High) written in the coupling capacitor 6 is written in the storage capacitor 5, inverting the state of the driving transistor 2 to an OFF state. Consequently, the anode potential of the organic EL element 1 is reduced to the cathode potential, which is Low. However, by setting the reset line 9 to Low once again and reading out the anode potential (Low) to the coupling capacitor 6 and then writing the anode potential in the storage capacitor 5 with the selection line being set to Low once again, the driving transistor 2 is turned ON. As a result, the organic EL element 1 emits light due to an electric current flowing therethrough, and the original state is thus recovered.

Similarly, when the organic EL element is turned OFF, the original state is maintained by repeating the operation in which the anode potential is read out to the coupling capacitor 6 and is written in the storage capacitor 5 two times.

Such a data holding operation as described above may be performed with the potential of the data line being set to any value as long as the potential of the data line 7 is kept fixed. Accordingly, with this data holding operation, as the need for charging and discharging the data line 7 can be eliminated, the power consumption can be reduced when displaying the same 1-bit video. Further, as it is not necessary to perform the operation at approximately 60 Hz, as required in video display, and the data holding operation can be performed at 30 Hz or less, further reduction in the power consumption can be achieved.

Figure 6:
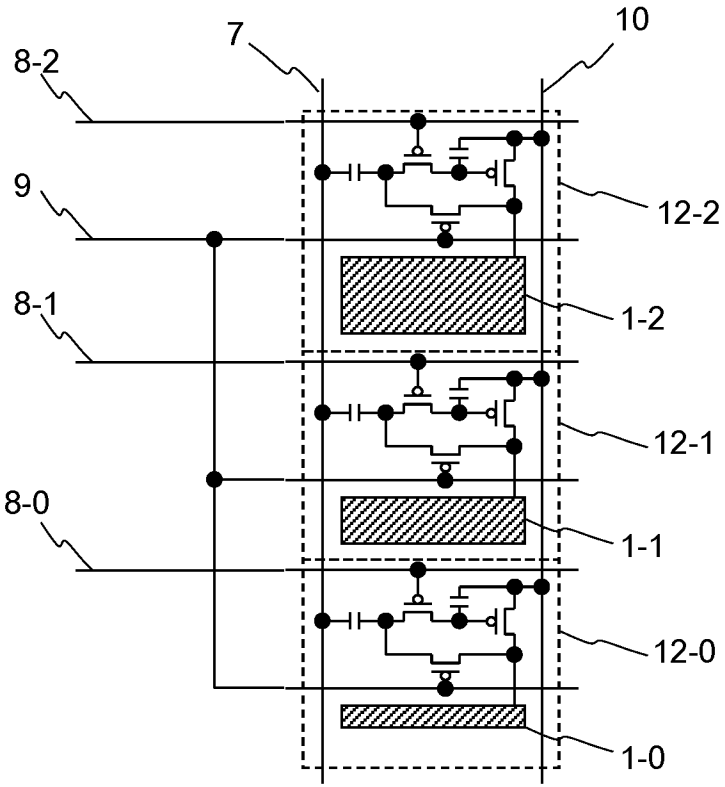
FIG. 6 is a diagram showing a structure of a pixel circuit in which sub-pixels are used.

As described above, as the pixel 12 operates as 1-bit memory, multi-bit display can be achieved by including a plurality of pixels 12 as sub-pixels within a pixel as shown in FIG. 6. FIG. 6 shows an example unit pixel which includes 3-bit sub pixels 12-2, 12-1, and 12-0 for enabling 3-bit display.

The sub-pixels 12-2, 12-1, and 12-0 include organic EL elements 1-2, 1-1, and 1-0, respectively, with their light emission intensities being set to a ratio of 4:2:1. The reset line 9 may be common among these sub-pixels 12-2, 12-1, and 12-0. By setting the selection lines 8-2, 8-1, and 8-0 simultaneously to Low and setting the reset line 9 to Low, the three sub-pixels can be reset simultaneously.

When writing each bit data in each of the sub-pixels 12-2, 12-1, and 12-0, only the relevant selection line is set to Low after the reset and the corresponding bid data is supplied to the data line 7, so that the corresponding bit data can be written in each sub-pixel.

At the time of a data holding operation, with the potential of the data line 7 being fixed, by setting the reset line 9 which is common among the sub-pixels to Low, the anode potentials of the organic EL elements 1 corresponding to three sub-pixels are read out simultaneously to the respective coupling capacitors 6, and then, after the reset line 9 is returned to High, with the selection lines 8-2, 8-1, and 8-0 being set simultaneously to Low, the anode potential read to the coupling capacitor 6 is written in the storage capacitor 5. With this operation, data in the three sub-pixels 12-2, 12-1, and 12-0 are inverted simultaneously, and, with the repetition of the same operation once again, the data are returned to the original data, so that the data once written in the pixel are held. In this manner, a static operation can be achieved.

Figure 7:
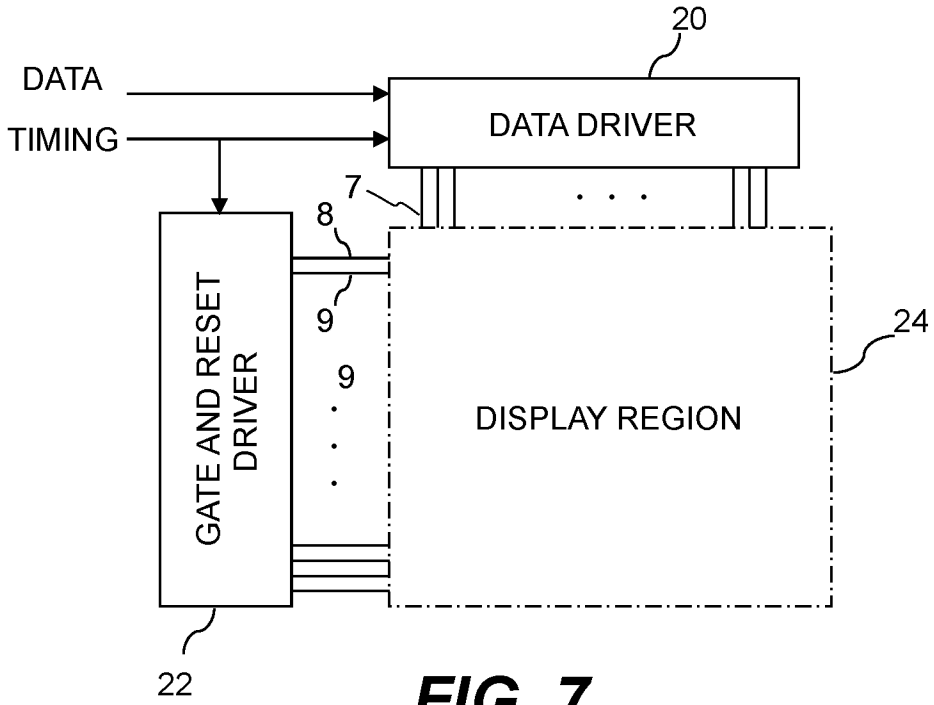
FIG. 7 is a diagram showing a structure of a display panel.

FIG. 7 shows an overall structure of a display panel. A data signal and a timing signal are supplied to a data driver 20 and are supplied, as required, to the data lines 7 which are arranged such that each data line 7 corresponds to a pixel or a unit pixel. Here, the data driver 20 is capable of outputting a pre-set voltage Vp. A gate and reset driver 22 controls the voltage of the selection line 8 and the reset line 9 in accordance with the timing. The selection lines 8 and the reset lines 9 are provided such that a pair of a selection line 8 and a reset line 9 is disposed corresponding to each row of the pixels or sub-pixels. In the above example, the voltage of the reset line 9 is controlled for each sub-pixel. Here, a display region 24 is an area including the pixels arranged in a matrix.

While p-type transistors are used in the example shown in FIG. 1, n-type transistors may be used. In this case, the polarities of the lines are appropriately changed. Further, while an organic EL element is adopted as a light emitting element in the example described above, other driven-by-current type light emitting elements may be used.

PARTS LIST

1 organic EL element
2 driving transistor
3 selection transistor
4 reset transistor
5 storage capacitor
6 coupling capacitor
7 data line
8 selection line
8-0 selection line
8-1 selection line
8-2 selection line
9 reset line
10 power source line
11 cathode electrode
12 pixel
12-0 subpixel
12-1 subpixel
12-2 subpixel
20 data driver
22 reset driver
24 display region

The invention claimed is:

1. A digitally driven display panel, comprising:

one or more data lines for a carrying one of only three predetermined voltage levels, a high level data potential ($V_h$), a low level data potential ($V_l$), or a pre-charge potential ($V_p$);

one or more selection lines;

one or more reset lines; and a plurality of pixels, wherein each pixel comprises:

a coupling capacitor having a first terminal connected directly to one of the one or more data lines;

a selection transistor having a first terminal connected to a second terminal of the coupling capacitor, and a gate connected to one of the one or more selection lines;

a driving transistor having a gate connected to a second terminal of the selection transistor, wherein the driving transistor supplies a current in accordance with a gate potential;

a light emitting element connected to a second terminal of the driving transistor and emitting light as a result of an electric current supplied by the driving transistor;

a reset transistor having a first terminal connected to the second terminal of the driving transistor, a second terminal connected to the first terminal of the selection transistor, and a gate connected to one of the one or more reset lines; and a storage capacitor connected to the gate of the driving transistor.

2. The digitally driven display panel of claim 1, further comprising:

a data driver for supplying a data signal to the one or more data lines.

3. The digitally driven display panel of claim 1, further comprising:

a gate and reset driver to control the voltage of the one or more selection lines and the one or more reset lines.

* * * * *